United States Patent [19]

Marcus

[11] 4,241,908

[45] Dec. 30, 1980

[54] JACKET CLAMPING DEVICE FOR A PAPER STUFFING MACHINE

[76] Inventor: Joel A. Marcus, 68-61 Yellowstone Blvd., Forest Hills, N.Y. 11375

[21] Appl. No.: 69,268

[22] Filed: Aug. 24, 1979

[51] Int. Cl.[3] ..... B65H 5/30

[52] U.S. Cl. ..... 270/55

[58] Field of Search ..... 270/54, 55, 57; 271/209, 210, 221, 222

[56] References Cited

U.S. PATENT DOCUMENTS

| | | | |
|---|---|---|---|
| 2,274,713 | 3/1942 | Kushera | 271/210 |
| 3,370,848 | 2/1968 | Bartlett | 271/221 |
| 3,420,516 | 1/1969 | Guggisberg | 270/55 |
| 3,450,400 | 6/1969 | Guggisberg | 270/55 |
| 3,761,080 | 9/1973 | Larson | 271/209 |
| 3,877,692 | 4/1975 | Kluge et al. | 270/57 X |
| 3,938,799 | 2/1976 | Macue | 270/55 |

*Primary Examiner*—E. H. Eickholt

*Attorney, Agent, or Firm*—Kirschstein, Kirschstein, Ottinger & Cobrin

[57] ABSTRACT

A clamping device which holds one half of a folded jacket against an inclined platen as an insert is dropped into the jacket against the fold. The platen is one of a large number of similar elements carried by a carousel which intermittently shifts the platens from station to station, the clamping device being rendered operative at one station and continuing to remain operative through several stations as one or more inserts are dropped successively into the jacket. The clamping device prevents the pages of the jacket from blowing open as inserts are dropped. The clamping device constitutes a flexible resilient arm, one end of which is fixed to an oscillating clamping bar that reciprocates the clamping device between an idle and an operative position. The tip of the arm supports a resilient pad that, when the arm is in operative position, presses against the inner surface of the jacket half that rests against the inclined platen.

10 Claims, 8 Drawing Figures

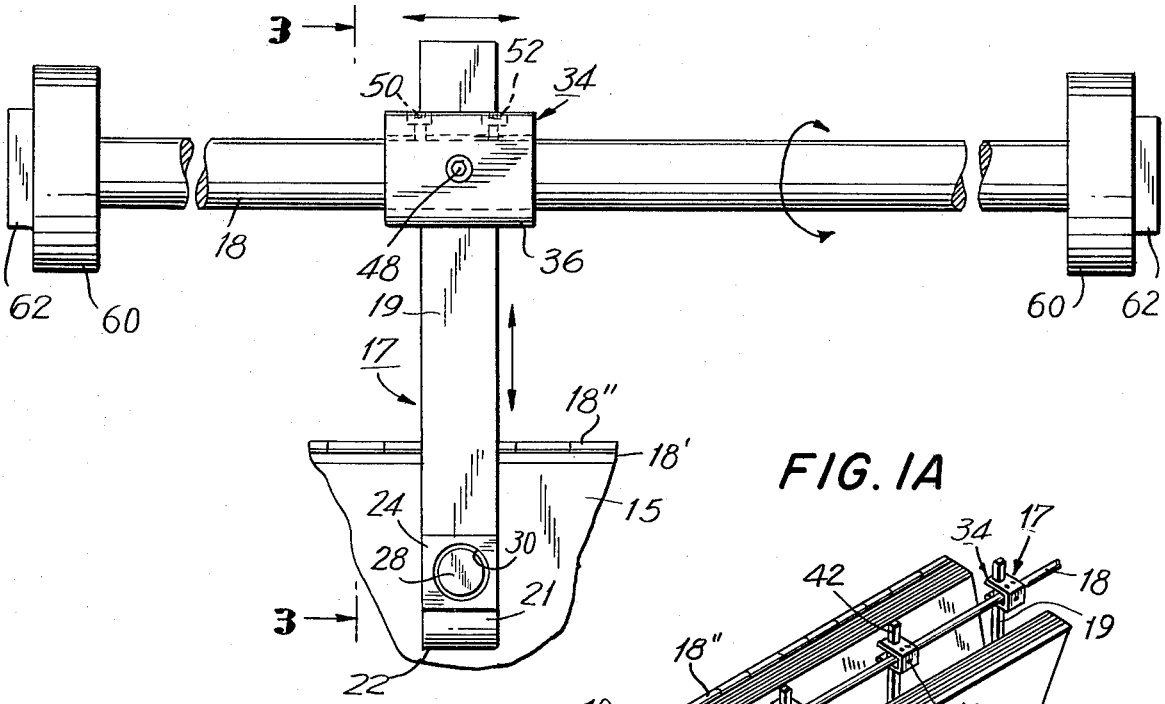
FIG. 2
FIG. 1A
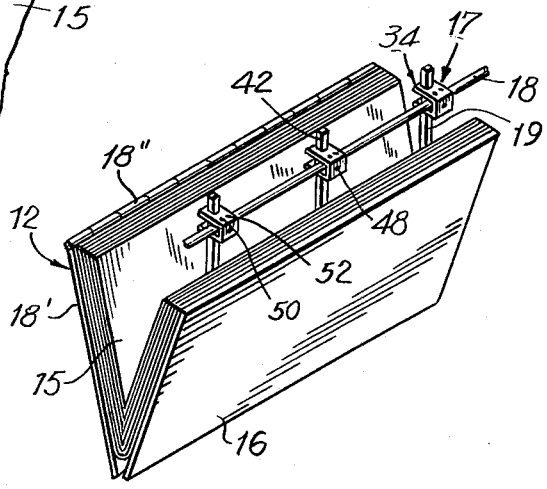
FIG. 1
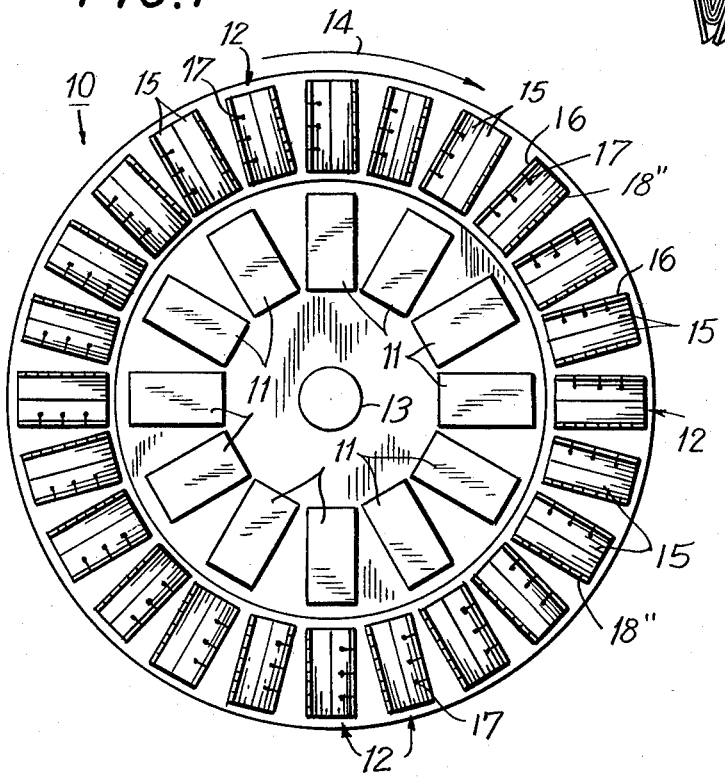
FIG. 4
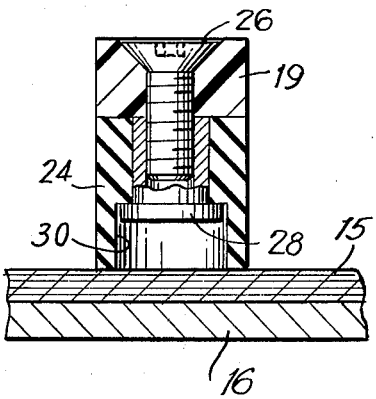

FIG. 3
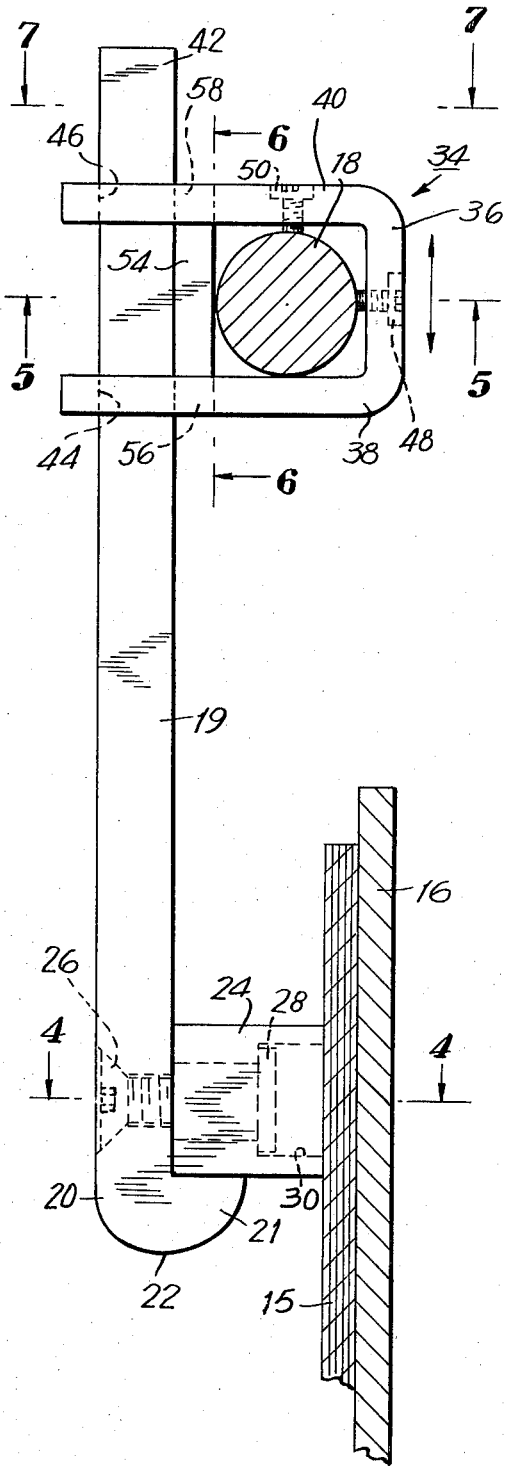
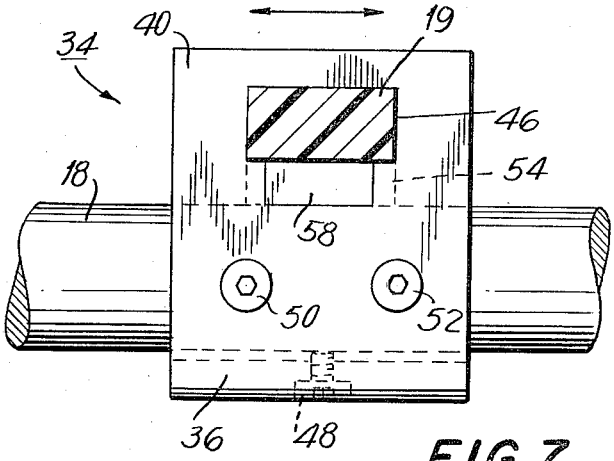
FIG. 7
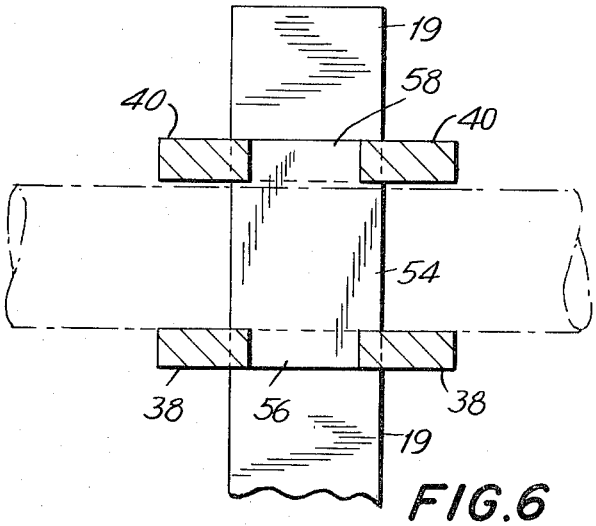
FIG. 6
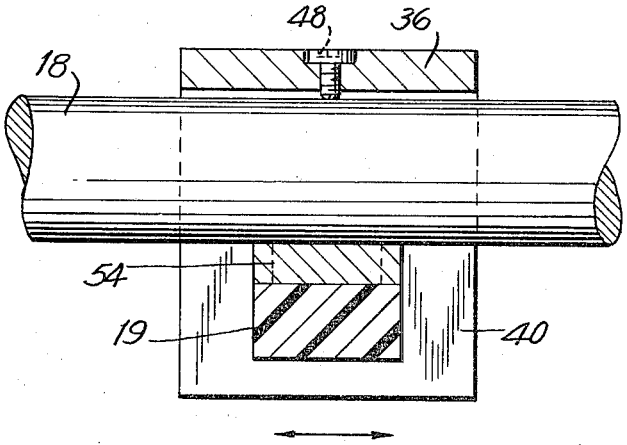
FIG. 5

JACKET CLAMPING DEVICE FOR A PAPER STUFFING MACHINE

BACKGROUND OF THE INVENTION

1. Field of the Invention

A clamping device for holding one half of a folded jacket against an inclined platen in the operation of a paper stuffing machine.

2. Description of the Prior Art

The clamping device of the present invention was created for use in a machine used for stuffing inserts for the assembly of a newspaper. Typical such machines are manufactured by Sheridan Company, a division of HarrisIntertype, located at Easton, Pa. These machines are known as stuffers; their purpose is to facilitate assembly of a newspaper that constitutes more than one section.

Consider, for example, a Sunday newspaper having a main news section and several additional sections such, for example, as a local news section, a world news section, a travel section, an entertainment section, a magazine section, a book section, a classified advertising section, and a sports section. These papers, as sold to the public, conventionally have one outer section, usually the main news section, referred to as the "jacket" which is folded in half and between the two halves of which the other sections, prefolded, are inserted, fold down. Sometimes the other sections are inserted one after another; sometimes the other sections are inserted as a bundle one inside another. Sometimes there are more than one multisection bundles and sometimes there is a mixture including bundles of sections and single sections one alongside another, all within the jacket.

The Sheridan stuffers are designed to insert these sections either in one another or in a jacket, that is to say, to "stuff" the internal sections into the jacket or into one another and then into the jacket. Stuffers, and particularly Sheridan stuffers, constitute carousels on which a large number of pockets are mounted. Typically, the number of pockets is 24, 48 and 72. A pocket is radially disposed around a center about which the carousel turns. The carousel intermittently shifts the pockets to successive stations where various operations are performed, typically stuffing operations; at a given station, the outer jacket is deposited in a pocket with its fold down and its halves angularly spread and at successive stations various newspaper sections are stuffed into the jacket by dropping the same therein. Typically, the number of stations varies from 4 to 13.

A pocket constitutes a pair of walls defining a V, one of the walls being stationary and being the stationary inclined platen of the pocket, and the other wall being movable from a position in which it forms the V to a position in which the bottom of the V is open to permit the newspaper sections after assembly with the outer jacket to be dropped onto a conveyor belt.

The outer section, i.e. the "jacket" which first is deposited in the pocket is composed of several sheets. It is folded in half and the fold is placed at the bottom of the pocket. Hence, the upper edges of the sheets at the two sides of the pocket are free and lie in juxtaposition only because they are so deposited in the pocket. However, these edges are susceptible to being fanned open if struck by a current of air. They act this way even if the sheets are joined by a fold at one upright edge which would tend to hold the horizontal upper edges of the sheets together adjacent this folded edge. This ability of the upper free edges to move apart is bothersome when a section is being dropped into a jacket in a pocket because as the section descends, either driven down or under its own weight, it creates a downward current of air directed at the free edges. The ensuing movement of the free edges is known as a "breezing open" and is most undesirable since the opening of the individual sheets of the jacket can cause enough movement to have some of the sheets caught by the descending section which folds, rumples or tears them.

To prevent such breezing open, present-day stuffers employ a clamping device, e.g. a clamping finger, for each pocket. Each pocket is provided with a horizontal clamping bar on which, conventionally, a rigid arcuate metal clamping finger is made fast. The clamping bar is oscillated about its longitudinal axis to move the finger from an idle position in which it is clear of the pocket to an operative position in which the tip of the finger presses against the inner surface of the half of the jacket that is lying against the inclined stationary platen.

Because the number of sheets can vary, present-day stuffers provide for an adjustable positioning of the operative location of the clamping finger. The clamping bar is oscillated by a kinematic linkage. Such linkage includes an adjustment, proper manipulation of which determines the operative position of the tip of the clamping finger. It is quite apparent that if the jacket includes a few sheets the operative position of the clamping finger must be quite close to the stationary platen of the pocket. On the other hand, if the jacket includes a large number of sheets, the linkage system must be adjusted so that the tip of the clamping finger in operative position is further from the stationary platen.

The foregoing arrangement for clamping a pocket-located jacket has many disadvantages. One is the noise which accompanies the operation of the clamping device. To better appreciate this problem, it should be pointed out that stuffing machines operate at a high speed, as high as 40,000 assembled newspapers per hour, and up to five inserts are stuffed into each jacket. This means that the fingers are oscillating quite rapidly. Each time that a finger strikes a jacket, there is a loud impact thud.

Another problem, and this is associated with the noise, is that the clamping fingers are supposed to be adjusted to assume a position which is related to the number of sheets in the jacket. Practically, however, the operators of the stuffers often do not make this adjustement, and indeed some older machines do not even have the adjustment, so that the machine runs from day to day without any change in the operative positions of the clamping fingers. A position is set for a very few sheets in a jacket to make certain that it will clamp a jacket having a minimum number of sheets. Accordingly, the noise of the tips of the clamping fingers hitting the stationary platen through the sheets becomes very loud.

This permanent or pseudo-permanent setting of the clamping fingers in a position, when operative, that is proximate to the stationary platen also means that a considerable pressure is exerted on the platen upon every operation of the fingers. It has been found in practice that the repetitive hammering away of the fingers on the platens wears an indentation into the platen. Accordingly, on present-day machines it is quite common to provide an insert in the platen at the zone of impact and to replace the insert from time to time.

Still further, for the same reason, i.e. the substantial force exerted by the tip of the finger on the jacket, the finger from time to time distorts, rips or perforates the sheets of the jacket, which obviously is undesirable.

SUMMARY OF THE INVENTION

1. Purposes of the Invention

It is an object of the present invention to provide an improved clamping device which overcomes the defects of present-day clamping devices.

It is another object of the invention to provide a clamping device which is quieter in operation and which will accommodate jackets of varying numbers of sheets without the necessity of adjusting the clamping bar.

It is a further object of the invention to provide a clamping device of the character described which is self-adjustable with regard to the number of sheets in the jacket.

It is another object of the invention to provide a clamping device of the character described which will absorb impact at the moment that clamping commences and thereby will have far less tendency to damage the sheets of the jacket and the stationary platen of the pocket.

It is another object of the invention to provide a clamping device of the character described which is adjustable linearly perpendicular to the axis of oscillation of the clamping bar so as to accommodate various lengths of sheets, e.g. broad sheets, tambloid sheets, comic sheets, quarter-fold sheets and other inserts.

It is another object of the invention to provide a clamping device of the character described which is not subject to the break-off problem that is associated with the standard screw mount clamp used by Sheridan in which the arms break off at the screw mount that is located on the small diameter clamping shaft.

It is another object of the invention to provide a clamping device of the character described which is adapted to be used on stuffing machines of various designs and various ages.

It is another object of the invention to provide a clamping device of the character described which easily can be substituted by the original equipment manufacturer for the current rigid clamping fingers at a printing plant or can be used to replace a previously installed rigid clamping device.

It is another object of the invention to provide a clamping device of the character described which can be easily adapted to existing stuffers by unskilled maintenance men and operators.

It is another object of the invention to provide a clamping device of the character described which constitutes relatively few and simple parts, is simple to manufacture and will operate for long periods of time without breakdown, and which is easy and rapid to replace.

These and other objects and advantages of the present invention will become evident from the description which follows.

2. Brief Description of the Invention

The present invention provides a clamping device, i.e. clamping finger, which is designed to be used with a conventional stuffer, that is to say, a stuffer having a pocket such as described previously, to wit, a pocket of V-shaped configuration wit one stationary inclined platen and one movable inclined platen, the pocket having associated with it a horizontal clamping bar on which the clamping device is to be mounted.

With this conventional background and equipment, the clamping device of the present invention, instead of being a rigid finger as heretofore, is a flexible finger, and the flexible finger is adjustably mounted on the clamping bar, the adjustment being both as to radial length and angular position, but, once mounted, is intended to retain its position permanently, as indeed are the rigid clamping fingers of the prior art. However, the instant clamping device, because it is flexible and resilient, is able to flex and accommodate a jacket composed of any number of sheets. Moreover, because it is resilient, the impact of its tip on the inner surface of the jacket is not as noisy and is not violent and will not do any noticeable damage to a jacket or to the underlying stationary platen. The resiliency of the clamping finger is enhanced by supplying it adjacent its tip with a resilient pad which is the element that actually engages the inner surface of the folded opened jacket. Because the finger is resilient, it can be used on any existing stuffing machine without modification thereof except for replacement of the finger. It can be used on machines which have an adjustment for the fingers and machines which do not have an adjustment for the fingers, the adjustment being one to accommodate the number of sheets in a jacket.

The present clamping device provides several salient advantages. The improved device vastly increases the efficiency in assembly of the newspaper. The device does not have to be replaced when adjustment of spacing is required. The tearing or breezing open of newspaper sections during assembly of the newspaper is effectively prevented. The clamping device is capable of infinitely variable adjustment or set, subject only to the constraints of its basic dimensioning. The present device obviates the necessity for many additional units in the installation, i.e. not as many units are required for a particular Sheridan inserter installation or machine. The device absorbs varying thicknesses of the newspaper sections without necessitating adjustment in each instance. The present clamping device may be mounted and used on any variety or age of Sheridan inserter, and can be set for any age machine where the position of the bar is or has been changed. In the present device, the backside of the arm is very smooth and free of protrusions which could rip or tear the paper. The device reduces wear and noise in operation during assembly of the newspaper sections. The present device is easily fabricated and assembled from inexpensive components.

The invention accordingly consists in the features of construction, combination of elements, and arrangements of parts which will be exemplified in the device hereinafter described and of which the scope of application will be indicated in the appended claims.

BRIEF DESCRIPTION OF THE DRAWINGS

In the accompanying drawings in which is shown one of the various possible embodiments of the invention:

FIG. 1 is an overall plan view of a pocketed carousel of a Sheridan inserter;

FIG. 1A shows a single pocket with jacket and clamping device in position;

FIG. 2 is an elevation view of the present clamping device;

FIG. 3 is a side view of the clamping device, taken substantially along the line 3—3 of FIG. 2;

FIG. 4 is a sectional plan view of a portion of the device, taken substantially along the line 4—4 of FIG. 3;

FIG. 5 is a sectional plan view of a portion of the device, taken substantially along the line 5—5 of FIG. 3;

FIG. 6 is a sectional elevation view of a portion of the device, taken substantially along the line 6—6 of FIG. 3; and FIG. 7 is a plan view taken substantially along the line 7—7 of FIG. 3.

DETAILED DESCRIPTION OF THE PREFERRED EMBODIMENTS

Referring now to FIGS. 1 and 1A, a carousel 10 includes twelve stationary inside stations 11 which receive stacks of sections of a newspaper for insertion into annular V-shaped pockets 12 which revolve about a central axis 13 in the direction indicated by arrow 14. Each pocket 12, as best shown in FIG. 1A, receives a folded jacket 15, with one half of the folded jacket 15 being held against an inclined platen 16 of the pocket 12 by a clamping device 17 held on a horizontal oscillating clamping bar 18 near the upper edge of said platen 16. The upper edge of the other inclined platen 18', which together with platen 16 forms the V-shaped pocket 12, is hinged at 18", so that when all of the newspaper sections have been inserted into the folded jacket 15, the hinged platen 18' is oscillated toward a more vertical position to open the pocket 12 thus permitting the completed newspaper to drop down onto a lower conveyor belt. Concomitantly, the bar 18 rotates about its longitudinal axis to move clamping device 17 away from jacket 15, so as to permit the jacket 15 as well as the inner sections of the newspaper to drop down as a completed unit newspaper, ready for distribution and sale.

In summary with regard to FIGS. 1 and 1A, the Sheridan inserter, also known as the Sheridan stuffer, includes a carousel 10 which is the equivalent of a dial machine. The rotary part illustrated in FIG. 1 carries the V-shaped pockets 12. The stations 11 are inside the carousel, and the stations 11 are fixed, i.e. stationary, with only the annular circular section including pockets 12 being rotated. Each pocket 12 has a clamping bar 18 alongside the upper edge of the stationary platen, and each pocket is V-shaped. The other wall or platen 18' rotates on a top hinge 18" between a V-shaped defining position, and a position in which the bottom of the pocket 12 is open to drop an assembled newspaper on a conveyor. At one station, the jacket 15 is dropped into the closed pocket 12 so that the jacket 15 opens up as a V with its fold lowermost. Then the clamping finger 17 moves in, so that the pad of the finger 17 to be described infra presses against the inner surface of one half of the jacket (FIG. 3). The pad of finger 17 presses against the inner surface near the top edge of the jacket 15 and about midway between the opposite ends. Then the pocket 12 containing the jacket 15 moves to another station where one or more sections of the newspaper are dropped in. The clamping finger 17 remains in clamping position until the last station, where the finger 17 swings up and the movable platen 18' swings out to open the bottom of the pocket 12 so that the assembled newspaper is dropped to a conveyor belt.

FIGS. 2-7 show the novel structure of the present clamping device employed in conjunction with the carousel 10. The device acts against one half of a jacket 15 and includes a flexible resilient arm 19 which is oblong in cross-section with its flat side facing the fixed wall of the pocket. The arm terminates at one end 20 with a right-angled tab 21. The arm is fabricated from a synthetic plastic, for example is molded of nylon. The outer periphery 22 of the junction at 20 between the arm 19 and the tab 21 is curved, as best seen in FIG. 3. A flexible resilient elastomeric pad 24 is mounted on the arm 19 adjacent the one end 20, and the pad 24 abuts against the underside of the tab 21 (FIG. 3). The pad 24, preferably composed of rubber or rubber-like material, e.g. Shaw 75 durometer rubber, is mounted to the arm 19 by providing a 10-32" flat head Allen screw 26 which extends through a back hole adjacent the end 20 of the arm 19, and which is screwed into a 10-32" twelve pointed stud 28 which is set into a hole 30 in the face of the pad 24. As best seen in FIG. 4, the head of the screw 26 is flush with the surface of the arm 19 so that no protrusion is present.

A Sheridan inserter oscillating clamping bar 18 extends through a U-shaped saddle 34 on which the arm 19 is mounted. The saddle 34 includes a flat base 36 from which two parallel legs 38 and 40 extend to engage the other end 42 of the arm 19. The arm 19 is slidably mounted in the saddle to permit adjustment of the radial distance of the pad 24 from the bar 18. The arm 19 extends through opposed openings 44 and 46 in the respective legs 38 and 40 of the bracket 34.

An Allen head set screw 48 having a cup point extends through the base 36 and two Allen head set screws 50 and 52 each having a cup point extend through the leg 40. All the cup points of the set screws engage the bar 18 so that the member 32 is firmly secured to the arm 19 by tightening the screws 48, 50 and 52. The set screws are loosened to enable the angular position of the arm on this bar to be set to any selected spacing between the pad 24 and the inner surface of the fixed platen 16.

A plate 54 having two opposed tabs 56 and 58 on opposite sides is disposed between the bar 18 and the arm 19. Each tab 56 or 58 extends into a slot in a leg 38 or 40 of the bracket 34, which slots are narrow extensions of the respective openings 44 and 46, as best seen in FIG. 7. When the set screw 48 is tightened it squeezes the plate between the bar 18 and the arm 19.

In operation, it is evident that the effective length of the arm 19 may be changed by merely sliding the arm 19 through the openings 44 and 46. Similarly, angular adjustment with respect to member 18 is possible merely by loosening the set screws 48, 50 and 52 and rotating the clamping device, i.e. arm 19, with respect to the member 18 to a new disposition after which the set screws 48, 50 and 52 are again tightened.

Numerous alternatives within the scope of the present invention will occur to those skilled in the art. Typical modifications of this nature may be mentioned. The arm may be changed to some other resilient material, the hole may be moved, the tab dropped or reduced; the pad may be changed in configuration to a cylinder, the mounting saddle 34 may be provided an additional screw on its base 36, one of the side screws 50 or 52 may be omitted; the screws may be provided with vibration dots.

To briefly summarize, in the present invention the improved clamping device generally includes an arm 19 which is oblong and terminates at one end with a tab 21. The arm 19 and terminal tab 21 are composed of resilient plastic materials, e.g. polyethylene, polypropylene especially isotactic polypropylene, polyvinyl chloride, nylon, etc. The tab 21 is an extension of and generally perpendicular to the arm 19. A flexible resilient elastomeric pad 24 is mounted on the arm 19 adjacent the outer end 20 of the arm 19. A U-shaped saddle 34, usually composed of a metal such as steel, or aluminum, and having a base 36 and two legs 38 and 40, has the arm slidably mounted on it, with the arm 19 extending through opposed openings 44 and 46 in the legs 38 and 40 of the saddle 34. Means is provided in the base 36 of the saddle 34 and/or in at least one leg 38 or 40 of the bracket for securement to the rocking bar 18 of a Sheridan inserter. The base 36 of the saddle 34 is on the same side of the arm 19 as the pad 24.

The arm 19 is typically a flat straight strip, and generally the outer periphery 22 of the junction between the arm 19 and the tab 21 will be curved. The pad 24 is preferably composed of a rubbery material such as natural rubber, neoprene, buna or the like, although flexible resilient plastics such as a foamed plastic material, e.g. foamed resilient polyurethan, also may be employed as the material of construction for the pad 24. The means in the saddle to secure the rocking bar 18 of the Sheridan inserter, to the arm 19, typically consists of at least one set screw, which set scew extends through a threaded opening in the saddle 34. In a preferred embodiment, the number of set screws is three, with two of the set screws 50 and 52 extending through threaded openings in a leg of the saddle and one of the set screws 48 extending through the base of the saddle.

In many instances, the plate 54 will be provided in combination in the clamping device. This plate 54 is mounted against the arm 19 opposite to the base 36 of the saddle 34 and extends between the legs 38 and 40 of the saddle. The plate 54 will generally be composed of the same material of construction as that of the saddle 34 as described supra, e.g. metal. In a preferred embodiment, the plate 54 is provided with opposed tabs 56 and 58 on opposite sides of the plate 54, which opposed tabs 56 and 58 each extend into a slot in a leg of the saddle. Each slot typically is an extension of the aforementioned opening in a leg of the saddle, through which the arm extends. Each slot will usually be narrower than the respective opening in the leg of the saddle.

Typically the paper being clamped by the clamping device will be a folded jacket or other section of a newspaper, although multi-section magazines, books brochures, advertising flyers, printed coupon folders, etc., may also be manipulated by the clamping device of the present invention.

Lateral bearings 60 (FIG. 2) support the bar 18, and lateral kinematic linkages 62 serve to oscillate the cylindrical bar 18 in a manner known to those skilled in the art.

It thus will be seen that there is provided a clamping device which achieves the various objects of the invention and which is well adapted to meet the conditions of practical use.

As various possible embodiments might be made of the above invention, and as various changes might be made in the embodiment above set forth, it is to be understood that all matter herein described or shown in the accompanying drawings is to be interpreted as illustrative and not in a limiting sense. Thus, it will be understood by those skilled in the art that although preferred and alternative embodiments have been shown and described in accordance with the Patent Statutes, the invention is not limited thereto or thereby.

Having thus described the invention, there is claimed as new and desired to be secured by Letters Patent:

1. A clamping device for a stuffer having a V-shaped pocket with one inclined stationary platen, and having associated with the pocket a horizontal clamping bar which is oscillatable about its longitudinal axis between an idle position and a clamping position, said clamping device comprising an elongated resilient arm, means mounting said arm on said clamping bar to extend radially therefrom, and a resilient pad mounted on the tip of the arm in a position to face the inclined stationary platen when the clamping bar is in its operative position, said pad engaging the inner surface of a half of a folded jacket in the pocket when said clamping bar is in operative position.

2. The clamping device of claim 1 in which the tip of the arm is provided with a tab, said tab being an extension of and substantially perpendicular to the arm, the resilient pad being mounted on the arm adjacent said tab so that the pad abuts said tab.

3. The clamping device of claim 2 in which the outer periphery of the junction between the arm and the tab is curved.

4. The clamping device of claim 2 in which an edge of the pad is nested in the corner formed between the arm and the tab.

5. The clamping device of claim 1 in which the arm is fabricated of synthetic plastic material.

6. The clamping device of claim 1 in which the means mounting the arm on the clamping bar is a substantially U-shaped saddle having a base and two legs, said arm being slidably mounted on the saddle with the arm extending through opposed openings in the legs of said saddle, together with means in the base of said saddle and/or in at least one leg of said saddle to secure the clamping bar to the arm, the base of said bracket being on the same side of the arm as the pad.

7. The clamping device of claim 6 in which the means in the saddle to secure the clamping bar to the arm comprises at least one set screw, said set screw extending through a threaded opening in the saddle.

8. The clamping device of claim 6 together with a plate mounted against the arm opposite to the base of the saddle and extending between the legs of the saddle.

9. The clamping device of claim 8 in which the plate is provided with opposed tabs on opposite sides of the plate, said opposed tabs each extending into a slot in a leg of the saddle.

10. The clamping device of claim 1 including means for adjustably ranging the angular and radial position of the pad with respect to the clamping bar.

* * * * *